United States Patent [19]

Brown

[11] 4,232,487

[45] Nov. 11, 1980

[54] ABRADING DEVICE

[75] Inventor: Donald J. Brown, Naperville, Ill.

[73] Assignee: Knox Manufacturing Co., Wood Dale, Ill.

[21] Appl. No.: 909,537

[22] Filed: May 25, 1978

[51] Int. Cl.[3] ..... B24C 3/06; B24C 7/00

[52] U.S. Cl. ..... 51/425; 51/427; 51/436; 51/438

[58] Field of Search ..... 51/425, 427, 429, 436, 51/438; 15/421

[56] References Cited

U.S. PATENT DOCUMENTS

| | | | |
|---|---|---|---|
| 847,269 | 3/1907 | Wise | 51/438 X |
| 1,106,231 | 8/1914 | Marshall | 15/421 X |
| 2,597,434 | 5/1952 | Bishop | 51/438 X |
| 2,628,456 | 2/1953 | Berg | 51/424 |
| 2,723,498 | 11/1955 | Hastrup | 51/427 X |
| 2,770,924 | 11/1956 | Mead | 51/427 |
| 2,810,991 | 10/1957 | Mead | 51/427 X |
| 3,032,929 | 5/1962 | Glesener | 51/427 |
| 3,073,070 | 1/1963 | Mead | 51/425 X |
| 3,283,450 | 11/1966 | Greenberg | 51/438 X |
| 3,599,375 | 8/1971 | Nunemuker | 51/429 X |
| 3,624,967 | 12/1971 | Kamper | 51/425 X |
| 3,906,673 | 9/1975 | Goto | 51/425 X |
| 3,934,372 | 1/1976 | Diehn | 51/425 |
| 4,020,596 | 5/1977 | Bergh | 51/425 |
| 4,045,915 | 9/1977 | Gilbert | 51/427 |
| 4,048,918 | 9/1977 | Peck | 51/427 X |
| 4,057,940 | 11/1977 | Wemmer | 51/438 |
| 4,067,150 | 1/1978 | Merrigan | 51/436 |
| 4,071,981 | 2/1978 | Champayne | 51/170 MT |

FOREIGN PATENT DOCUMENTS

| | | | |
|---|---|---|---|
| 314063 | 5/1956 | Switzerland | 51/429 |

*Primary Examiner*—Gary L. Smith

*Attorney, Agent, or Firm*—Wegner, Stellman, McCord, Wiles & Wood

[57] ABSTRACT

An abrasive surface treating device includes a gun connected to a pressurized air source, a housing containing a supply of abrasive material, an abrasive delivery line connected to the gun and having an aperture adjacent the housing outlet, a shroud to capture spent abrasive, and a vacuum source to draw spent abrasive and debris from the shroud back to the interior of the housing. The delivery of air at high velocity through the gun draws air through the abrasive delivery line via the aperture and thereby draws abrasive from the housing into the air stream flowing from the aperture to the gun so that the abrasive may be propelled against a work surface. The effective size of the aperture may be changed to alter the flow rate of various abrasive materials. In addition, the gun and abrasive delivery line may be connected to an adapter which, in turn, receives a shroud member having a configuration selected in accordance with the shape of the work surface.

47 Claims, 6 Drawing Figures

ABRADING DEVICE

BACKGROUND OF THE INVENTION

1. Field of the Invention

This invention relates generally to a surface treating apparatus and, more particularly, to a system for delivering abrasive particles against a work surface and recycling the particles for reuse.

2. Description of the Prior Art

The use of abrasive, such as particles of sand or grit, to burnish or remove the finish from a surface is known. In operations, such as sandblasting, the sand is propelled against the work surface in a stream or current of high velocity air which carried the sand and is directed at the surface. The impingement of the sand against the work surface wears away or erodes the top layer of the work. Typically, the sand is widely scattered so that it is wasted. Further, the wasted sand and the debris from the work surface pollutes or otherwise contaminates the surrounding area.

Enclosures have been employed to contain the abrasive within the work area. Such enclosures have included shrouds surrounding the sandblasting gun for capturing spent sand and debris and systems for recirculating the captured sand for reuse. However, the abrasive blasting systems employed in the prior art have been relatively intricate in structure and often required complex valves or jet nozzle assemblies. As a result, the prior art devices have been relatively expensive.

SUMMARY OF THE INVENTION

It is the principal object of the present invention to provide a simple surface treating apparatus for delivering abrasive grit to a work surface, recapturing the grit and recycling the grit for reuse.

In accordance with the invention, an abrading device includes a gun connected to a pressurized air source, a housing containing a supply of abrasive material, an abrasive delivery line between the bottom of the housing and an abrasive inlet in the gun having an aperture adjacent the housing outlet, a shroud to collect spent abrasive, and a vacuum source to draw the spent abrasive from the shroud through an abrasive retrieval line back to the interior of the housing above the abrasive supply. The stream of pressurized air through the gun passes over the abrasive inlet to draw air through the abrasive delivery line via the aperture thereby drawing abrasive from the housing bottom into the air stream of the gun and propelling it against a work surface.

In an exemplary embodiment of the invention, the abrasive is sand which is maintained at a depth sufficient to maintain a separating barrier between the low pressure area above the sand in the housing and the sand outlet at the bottom. A screen disposed slightly above the sand serves to remove large particles of sand or debris which cannot be recirculated, while a filter collects smaller particles of used sand or debris which do not have enough weight to fall to the bottom of the housing against the action of the vacuum source.

A metering mechanism may be employed to control the rate at which the sand is delivered and is operated by the user to selectively change the size of the aperture thereby effecting a rate of change in the air flow through the sand delivery line, which in turn changes the rate of flow of sand from the housing outlet through the sand delivery line. The metering mechanism also enables the gun to be operated from the pressurized air source at varying pressures, e.g., from 30 pounds per square inch to 90 pounds per square inch, so that the velocity and the amount of the abrasive striking the work surface can be regulated in accordance with the nature of the material of that work surface.

The shroud has a resilient seal positioned about its open forward end to seat against the work surface and a resilient seal about an aperture at its rear to provide a snug fit with the gun barrel inserted into the aperture and yet permit pivotal-type movement of the gun so that abrasive may be selectively directed to any portion of the work surface enclosed by the shroud.

In a preferred embodiment of the invention, the shroud structure may comprise a shroud member which is releasably joined to an adapter. The adapter is configured to be attached to the barrel of the gun and to the upstream end of the sand retrieval line. The shroud member, which may be made in a variety of configurations, is inserted into the adapter and is releasably held by a ball detent mechanism. The adapter eliminates the necessity of removing the gun and disconnecting the sand retrieval line whenever the shroud member is changed.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENTS

Figure 1:
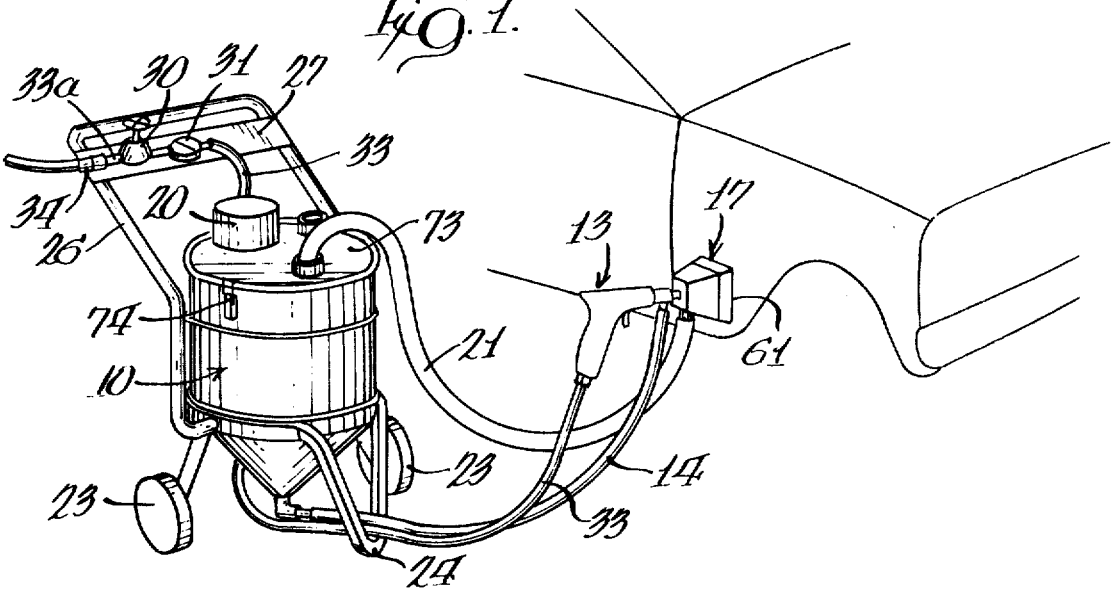
FIG. 1 is a perspective of an embodiment of the abrading device of the invention and illustrates its use on an automobile fender.
Figures 2, 3:
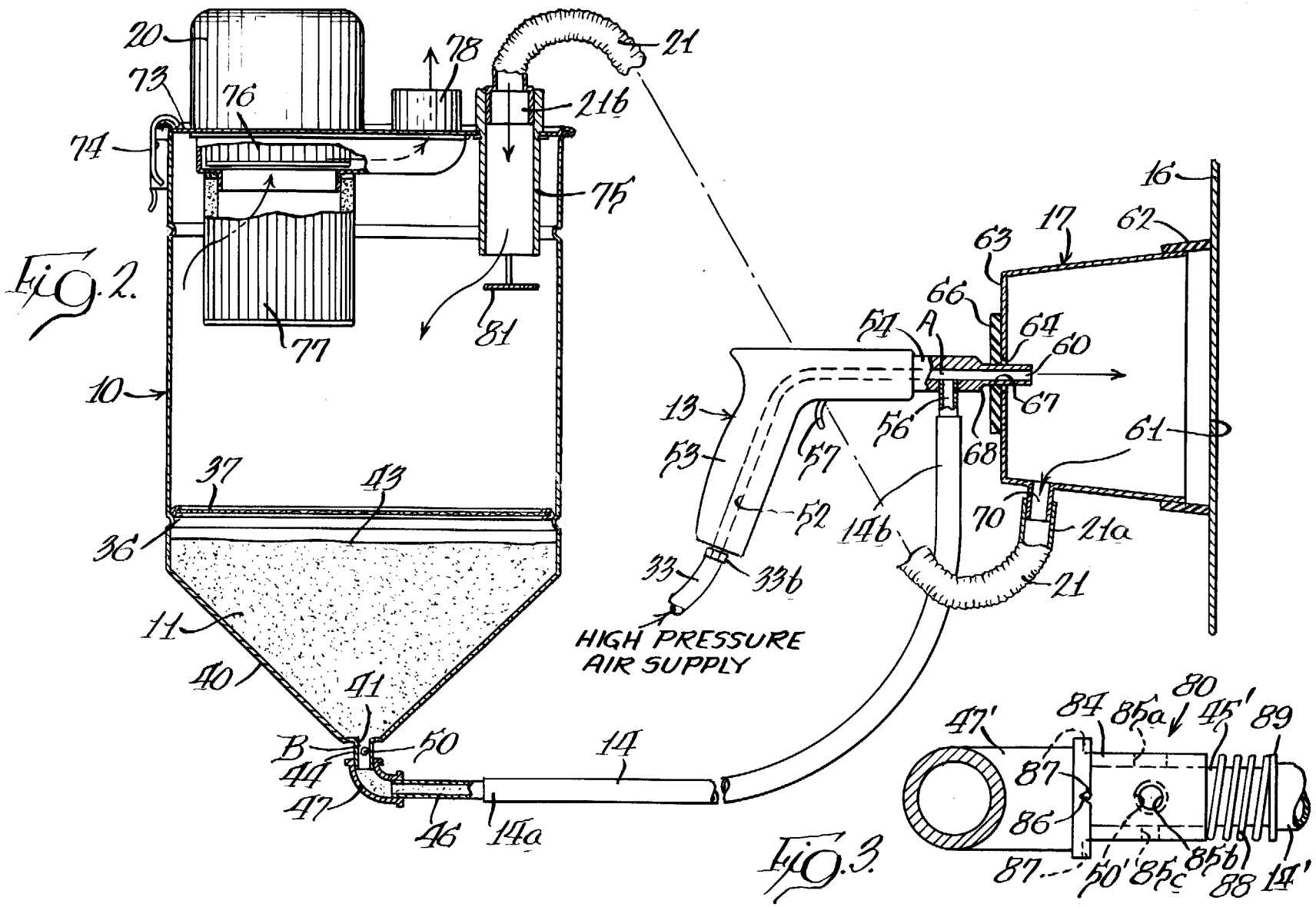
FIG. 2 is a fragmentary, side elevational view of the invention, partially in cross section, illustrating the flow of the abrasive material.
FIG. 3 is a top elevational view of a variable aperture which may be used in connection with the present invention.

Referring to FIGS. 1 and 2, an abrasive surface treating apparatus is seen to generally include a housing or cannister 10 providing an internal reservoir for abrasive material, such as sand 11, a gun 13 for propelling sand delivered through a supply conduit 14 against a work surface 16, a shroud 17 for capturing used sand and debris, and a vacuum motor 20 for withdrawing sand from the shroud 17 through a retrieval conduit 21 so that spent sand is returned to the interior of the cannister 10. It is understood that while sand of different sizes or grits may be used as the abrasive material, other materials may also be utilized, such as garnet granules, glass beads, ground corn cobs, or crushed nut shells.

As seen in FIG. 1, the cannister 10 is supported by a frame which includes a pair of rear wheels 23, a front leg 24, and a rearwardly extending roughly U-shaped handle 26. Secured to a cross member 27 fixed across the handle 26 are a pressure regulating valve 30 and a pressure gauge 31 which are connected along a pressurized air conduit line 33, the valve 30 varying the velocity of the pressurized air in the conduit line 33. The upstream air end 33*a* of the air conduit 33 is joined by way of a quick disconnect nipple and connector coupling 34 to an external air supply providing air under high pressure. When not in use, the flexible hose lines making up the conduits 14, 21 and 33 may be wrapped about the cylindrical exterior of the cannister 10 inside of the handle parts.

The cannister 10 has an annular inside rib 36 which provides support for a screen 37. The screen 37 separates out any particles that may be too large for the line 14 leading from the bottom of the cannister 10 to the gun 13. The bottom wall 40 of the cannister 10 is preferably hopper-shaped to funnel sand within the interior of the cannister 10 downwardly toward an outlet 41 which is at the bottom center thereof. The sand 11 has a depth thickness which is maintained within a range to provide a pressure barrier, the depth being dependent on the diameter of the cannister and the type of abrasive employed. The sand 11 in the reservoir has an upper surface layer 43 which is maintained at a height relatively close to the bottom of the screen 37.

Extending vertically downward from the outlet 41 is an outlet tube 44 defined by the cannister housing which is connected to a generally horizontally oriented second tube 46 by way of an elbow fitting 47. It is understood that this outlet structure may be integrally constructed, if desired. An aperture 50 is defined in the outlet tube 44, preferably spaced approximately one inch from the outlet 41 and, for the example illustrated, has a diameter of approximately 3/16 inch. The purpose of the aperture 50 will be described hereafter. The upstream end 14*a* of the sand supply line 14 is connected to the tube 41.

The gun 13 has a passageway 52 which extends through its hand grip 53 and its barrel 54. The downstream end 33*b* of the air pressure hose 33 is connected to the hand grip end of the passageway 52. The barrel 54 is provided with an inlet tube 56, preferably approximately 5/16 inch in diameter, which makes a T-connection with the downstream end of the passageway 52. The downstream end 14*b* of the sand supply line 14 is operatively connected to the tube 56.

The gun 13 is provided with a trigger 57 which is connected to conventional means (not shown) for admitting or shutting off the flow of pressurized air to the barrel 54. The trigger 57 may either operate a valve within the gun 13 or operate a solenoid which turns on or shuts off the external pressure source itself. When the trigger 57 is actuated, rapidly flowing air under pressure is directed to the passageway 52 through the barrel 54 and out the open end 60 of the gun. The air in the passageway 52 moving rapidly over the open end of the inlet tube 56 creates a low pressure point or space at A so that sand is drawn through the supply line 14 and is caused to enter the passageway 52. The sand is then carried along by the rapidly moving air, out of the gun at 60 and against the work surface area 16.

The shroud 17 is a cup-shaped enclosure for recapturing sand which has been propelled against the surface area enclosed by the shroud. The shroud 17 prevents sand and debris from being dispersed into the ambient air. As shown in FIGS. 1 and 2, the four sides of shroud 17 are trapezoidal, and the shroud has a forward end 61 which faces the work surface with an open area that may be, for instance, about eight inches across. Disposed about the periphery of the shroud 17 at its forward end is a resilient rubber seal 62 which provides a closely fitting seat with the work surface 16. Since the interior of the shroud 17 is maintained at a pressure below atmosphere, any leakage between the seal 62 and the work surface 16 will be atmospheric air drawn into the shroud 17. The flow of air around the shroud edges will be effective in containing sand and debris within the interior of the shroud.

The rear wall 63 of the shroud defines an aperture 64 through which the barrel 54 of the gun is inserted. The aperture 64 is of such size that a fairly close fit is made with the barrel, but permits the gun to be moved pivotally so that it can be directed downwardly, upwardly or sidewardly to control the direction in which the sand is propelled against the work surface. In order to prevent the leakage of air through the aperture 64 between the gun barrel 54 and the shroud 17, a resilient seal 66 is fixed to the exterior of the rear wall 63 of the shroud. The resilient seal 66 has an aperture 67 which is aligned with the aperture 64 in the rear wall and is of such size that it makes a tight fit with the barrel 54 of the gun. As a result, leakage of air is minimized through the shroud aperture 64. The gun barrel 54 defines a beveled shoulder 68 which may be urged by the user against the seal 66 partially into the aperture 64 to further insure a tight seal. Thus, sand may be directed at high velocity from the barrel of the gun against the work surface area and the gun can be swiveled so that sand can be made to impinge upon all of the work surface within the confines of the shroud 17. Formed at the bottom of the shroud 17 is an opening defined by an outlet tube 70 to which the upstream end 21*a* of the sand retrieval line 21 is detachably connected.

The vacuum motor 20 is mounted on the cannister lid 73 which seals the top of the cannister 10 and may be removed therefrom by releasing lock members 74. The sand retrieval line 21 is detachably connected to the cannister 10 by inserting its downstream end 21*b* into an inlet tube 75 extending through the lid 73. The vacuum motor 20 drives a fan element 76 which draws air from the interior of the cannister 10 through a removable filter bag 77 and exhausts it externally via an outlet 78. Thus, the interior of the cannister 10 above the sand 11 is evacuated so that the pressure therein is substantially less than atmospheric. Consequently, spent sand and debris removed from the work surface will be drawn into the cannister 10 from the shroud 17 through the retrieval line 21.

The size of the cannister and the type of vacuum motor of the present invention may generally correspond to that of the ordinary wet-dry type of shop vacuum which frequently is used in small shops to clean up debris.

A plastic deflector 81 is provided within the interior of the cannister 10 to slow down the rapidly moving sand and dust that has entered the interior of the cannister. While the lighter particles are drawn to the filter bag 77, the heavier sand particles drop by gravity to the bottom of the cannister. The sand will then pass through the screen 37 and fall onto the top of the sand pile 11 to replenish the sand pile and maintain the depth of the sand pile. This sand may then be reused by redirecting it to the gun.

The filter bag 77 filters any debris coming in from the sand retrieval line 21 which is of a size and weight to become airborne so that dust and small particles will not be discharged out into the ambient air. Any dust or particles which are airborne come within the influence of the evacuating motor 20 and are gathered within the interstices of the filter bag 77. The filter bag 77 may be replaced when heavily laden with dust and dirt by removing the lid 73. It is understood that the filter bag may be located externally of the housing so that dust and small particles are directed out of the outlet 78 into such an external bag.

In operation, the apparatus establishes a complete circuit for flow of abrading material from the reservoir within the cannister to the blasting gun and to the work surface and from the work surface back to the top of the reservoir within the cannister so that the abrading material can be reused. Importantly, the device can be used in an enclosed shop without the necessity of a special discharge line to the exterior air outside the shop.

Because of the structural and functional features included in the present invention, abrasive flowing from the cannister through the abrasive conduit to the gun is metered into a uniform and even flow, which flow of abrasive can be varied in amount per unit time even during operation of the invention. Furthermore, the unique features included herein enable the device to be operated satisfactorily throughout a large range of operating pressures in the gun (e.g., from 30 pounds per square inch to 90 pounds per square inch) so that the eroding action of the abrasive on the working surface can be controlled in accordance with the nature of the material of that surface upon which work is being performed. Importantly also, this abrading device thus accommodates itself to a wide range of air compressor capacities which may be found in small shops where the device may be used.

Within the system, pressures are maintained at levels less than one atmosphere. Pressures below atmospheric exist within the gun 13 at A, within the outlet tube 44 at B, within the shroud 17, and within the cannister 10 above the sand pile 11. The sand supply line 14 is at low pressure because of the high velocity current of air within the passageway 52 moving across the end of sand inlet tube 56, while the sand retrieval line 21 is at low pressure because of the vacuum created in the cannister 10 by the vacuum motor 20.

Because the interior of the shroud 17 during operation is kept at low pressure by the vacuum within sand retrieval line 21, extremely turbulent action is imparted to the sand. The initial velocity of the impinging sand upon the surface of the work and the extremely turbulent action of the sand within the shroud enhance the cleaning action upon the surface of the work. In addition, because of the low pressure within the shroud 17, atmospheric pressure urges the shroud against the work surface 16.

The aperture 50 renders the upstream end **14*a* of the sand supply line 14 open to atmosphere and causes a quantity of sand to be set in motion and flow through the supply line 14 from the reservoir to the gun 13. The level of sand is maintained at an appropriate level to provide a barrier or separating medium. In the illustrated embodiment, satisfactory results have been obtained by providing about six inches of sand between the low pressure area within the cannister above the sand and the low pressure area in the outlet 41 below the sand at B, although this depth may be varied depending upon the granular nature of the abrasive, the volume of the cannister, and the size and exhausting capabilities of the vacuum motor 20. The barrier sand at the bottom of the cannister 10 permits the creation of a lower pressure in the supply line 14 by air pressure through the gun and by ingress of air through aperture 50 than the vacuum motor 20 can create in the lower part of the sand 11 near the outlet 41. A barrier of insufficient depth will permit air to be pulled upwardly through the sand and to the top of the reservoir against the forces created within the supply line 14 at the outlet 41**.

When the aperture 50 is open and the valve in the gun is open, incoming atmospheric air flows from the aperture toward the gun 13 and the venturi or siphon effect generated at B pulls the sand 11 into the supply line 14 and, with the stream of air, the sand flows toward the gun. While mention is made of the sand being pulled, it is understood that air flows from a zone of high pressure toward a zone of lower pressure so that the sand is forced or pushed by air flowing in this manner.

The function of the aperture 50 can be better understood by noting that if the aperture 50 was closed entirely and the cannister 10 was being evacuated, very little sand would flow through the sand supply conduit 14 to the gun when air under pressure was delivered through the gun passageway 52 across the end of the sand supply line 14. When the device is rendered completely inoperative, some sand falls by gravity through the outlet 41 in the bottom of the cannister hopper. When the vacuum motor is turned on to evacuate air from the cannister above the top surface of the sand and from the shroud 17, but no air pressure is delivered through line 33 to the gun 13, atmospheric air from the aperture 50 will be pulled upwardly through the outlet 41 and the abrasive 11 so that abrasive which might have fallen by gravity into the outlet 41 will, in large measure be pulled back up into the outlet tube 44 and into the cannister 10. Similarly, abrasive which is in conduit 14 will be returned or moved past the fitting 47 and the aperture 50 to the reservoir for abrasive in the cannister. It should be noted that the height of the sand barrier may be substantially greater than six inches, depending upon the factors pointed out above. However, since the device is intended to be lightweight and portable for indoor use and since a large reservoir of abrasive is not required because the abrasive is continuously recirculated, an excessive amount of abrasive is not required within the cannister 10.

The function of aperture 50, and of varying sizes of such apertures, has been studied utilizing a transparent plastic abrasive supply line 14. Under conditions established with the aperture 50 completely closed, the motor 20 activated to evacuate shroud 17 through abrasive retrieval line conduit 21, and the high pressure air flowing through air supply line 33 and gun 13, the abrasive 11 initially generally moves a short distance into the supply line 14 until the sand 11 substantially totally plugs the sand conduit 14. With increased air pressure at the gun, the sand tends to move farther down the conduit, but the conduit still remains substantially plugged. Occasionally a portion of the sand nearest the gun will break off and pass down the conduit, through the gun and against the working surface; however, this minor flow of sand is erratic, it is uneven and non-uniform, and it is unsatisfactory in performing an abrading operation. It is believed that the line 14 plugs because a kind of pressure balance is established between low pressure zones in conduit 14 and in the cannister 10 above the abrasive 11, and because of the absence of a flow of air to propel the abrasive through conduit 14.

When the aperture 50 is opened under the above conditions, the ambient air moves rapidly through the aperture 50, through the tortuous maze of air flow passages between adjacent granules of abrasive, and toward the low pressure zone within conduit 14 caused by the air pressure flowing within gun 13. This flow of air through aperture 50 rapidly unplugs conduit 14 and uniformly carries the sand from the reservoir, through conduit 14 to the gun 13. As observed through the transparent supply line 14, for a satisfactory abrading operation, the supply line is not completely filled with abrasive, but rather a much smaller quantity of abrasive forms a uniform stream of spaced abrasive granules and is carried along in the flow of air from aperture 50.

By using varying sizes of apertures 50, the rate of flow of air through conduit 14 can be controlled which in turn controls the rate of flow and the amount of abrasive 11 being delivered to the gun by the air flow. In other words, the abrasive flowing from the reservoir can be metered and varied as to quantity of abrasive flow to adapt the device to the particular exigencies of a given abrading operation to be performed. Additionally, this adjustability provided by variable sized apertures 50 enables the utilization of a wide range of air pressures at the gun 13 to control the velocity of the abrasive impinging upon the work surface so that the eroding action at the surface can be varied in accordance with the nature of the material of the surface and the desired effect to be produced upon the surface.

The device heretofore described has been operated to determine empirically the amount of garnet (#36 grit) abrasive circulated in one minute from the cannister 10 to the shroud 17 and back to a collection reservoir in a second similar operating cannister. The operation was conducted utilizing varying-sized apertures above the elbow fitting 47 and utilizing varying operating air pressures in the gun 13.

The resulting amount of abrasive circulated in one minute is set out in the following table:

| | | AIR PRESSURE IN GUN | | |
|---|---|---|---|---|
| | | 30 psi | 40 psi | 50 psi |
| DIAMETER | 1/16" | Little or None | 2 oz. | 7½ oz. |
| | 3/32" | 15 oz. | 1# 14 oz. | 2# 9 oz. |
| OF | ⅛" | 1# 15 oz. | 2# 14 oz. | 3# ⅛ oz. |
| | 5/32" | 2# 9½ oz. | 2# 7 oz. | 3# 2½ oz. |
| APERATURE | 3/16" | 2# 5 oz. | 2# 12 oz. | 3# 8 oz. |
| | ¼" | 1π 13 oz. | 2# 6 oz. | 2# 15 oz. |
| | 5/16" | 1# 1 oz. | 1# 9½ oz. | 1# 8½ oz. |
| | ⅜" | 6½ oz. | 10 oz. | 10 oz. |
| | 7/16" | Little or None | Little or None | Little or None |

From the above observations it can be seen that the weight or amount of abrasive circulated can be varied or controlled by varying the size of the aperture 50, and/or by varying the operative air pressure in the gun. Thus, these two control factors can be utilized when preparing a surface of a soft metal such as aluminum so that the surface is not excessively eroded. Similarly, control and adjustment of quantity of sand and or air pressure can be utilized in removing rust from casement (metal) windows, particularly in the corners adjacent the window glass. The controls are important also in using the device to clean uneven surfaces of brick or similar material.

After an abrading operation when the pressure to the gun is shut off, some circulating abrasive initially remains in the abrasive conduit 14. However, with the aperture 50 above the elbow fitting 47, and with the upper portion of the cannister 10 being evacuated, the abrasive in the conduit 14 is almost immediately returned past the fitting 47 and the aperture 50 to the sand 11 within the cannister, thus clearing abrasive from the conduit 14.

Referring to FIG. 3, a metering mechanism 80 is illustrated positioned downstream of the elbow fitting 47 and connected to the upstream end of the conduit 14. Such a metering mechanism may also be employed above the fitting 47, if desired.

The structure of metering mechanism 80 provides for selective adjustment of the effective size of aperture 50' to fit the particular needs of a given abrading operation. As seen in FIG. 3, the aperture 50' is formed in the top of the horizontal tube 45'. A sleeve 84 having a plurality of different sized apertures 85*a*, 85*b* and 85*c* spaced circumferentially is disposed about the tube 45'. The tube aperture 50' preferably has a diameter of about 3/16 inch, while the sleeve apertures 85*a*, *b* and *c*, respectively, preferably measure about 3/16, 5/32 and 3/32 inches. The sleeve 84 may be rotated to selectively align one of the apertures 85*a*, *b* or *c* with the tube aperture 50' to change the effective area thereof. To locate and maintain alignment of the sleeve 84 on the tube 45', the sleeve 84 has a pin 86 which engages one of the slots 87 formed in the shoulder of the elbow fitting 47'. A spring 88 bears against a fixed collar 89 on line 14' and urges the sleeve 84 and pin 86 in axial engagement with a selected slot 87. By adjusting the size of the aperture communicating into line 14', the rate of flow of the sand can be controlled. The variable aperture also accommodates suitable adjustments for different types of abrasive material.

The device of the present invention has been operated with metering mechanism 80 to determine empirically the amount of garnet (#36 grit) abrasive circulated in one minute from the cannister 10 to the shroud 17 and back to a collection reservoir in a second similar operating cannister. The operation was conducted utilizing varying-sized apertures, and utilizing varying operating air pressures in the gun 13. The apertures were spaced approximately three inches from the vertical axis of the fitting 47. The resulting amount of abrasive circulated in one minute is set out in the following table:

| | | AIR PRESSURE IN GUN | | |
|---|---|---|---|---|
| | | 30 psi | 40 psi | 50 psi |
| DIAMETER | 1/16" | 5½oz. | 9 oz. | 1# 6 oz. |
| | 3/32" | 1# 12 oz. | 2# 3 oz. | 2# 9 oz. |
| OF | 5/32" | 1# 9½oz. | 2# 9 oz. | 2# 14 oz. |
| | 3/16" | 1# 6 oz. | 2# 8 oz. | 2# 8 oz. |
| APERTURE | ¼" | 14½ oz. | 1# 10 oz. | 1# 14½ oz. |
| | 5/16" | Little or None | 1 oz. | 2½ oz. |

Again, the weight or quantity of abrasive can be varied and controlled by varying the size of the aperture in the metering mechanism 80 so as to adapt the device of the present invention to the needs of the particular abrading operation being performed in accordance with the nature of the material of the surface to be abraded and the desired effect to be produced upon the surface.

After an abrading operation utilizing metering mechanism 80, when the pressure to the gun 13 is shut off, some circulating abrasive initially remains in the abrasive conduit 14. However, the balance of pressure in this situation described above is such that the line or conduit 14 is almost immediately cleared to the shroud 17 and back to the top of the cannister 10, rather than as was the case with aperture 50 above the fitting 47. This clearing of conduit 14 to the shroud 17 is believed to be a function of the additional barrier of abrasive upstream of the aperture 50' and the positioning of the aperture 50' downstream of the elbow fitting 47.

Figure 4:
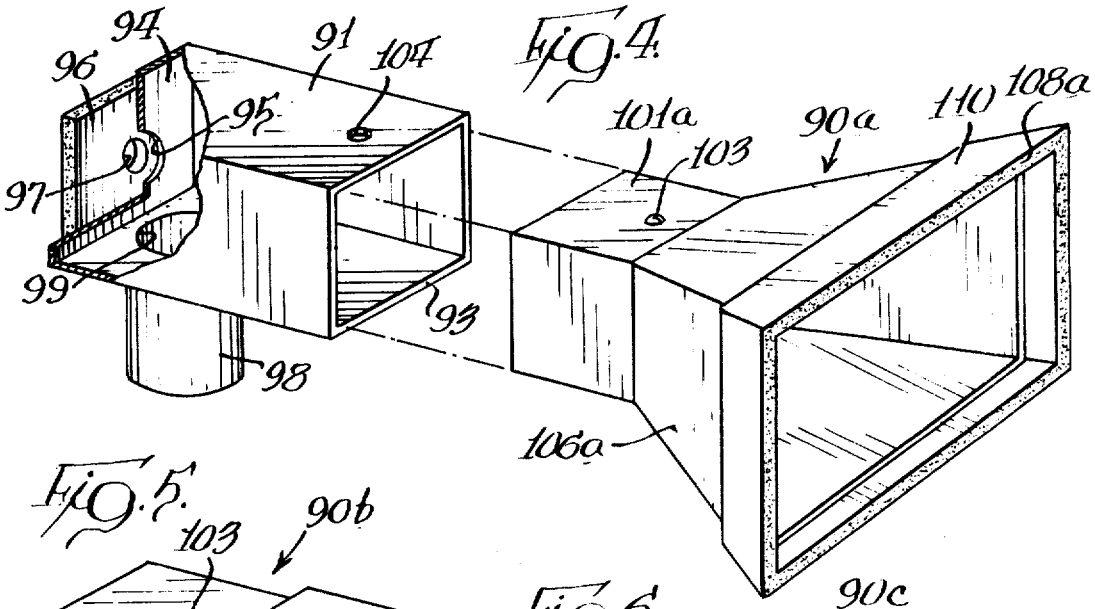
FIG. 4 is an exploded, perspective view of a shroud construction, partially in cross section, showing an adapter to which one type of shroud may be attached.
Figure 5:
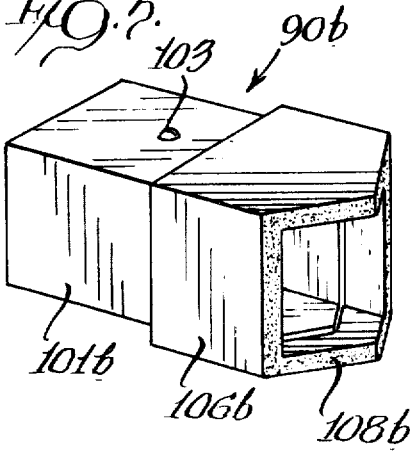
FIG. 5 is a perspective view of another type of shroud which may be employed with the adapter.
Figure 6:
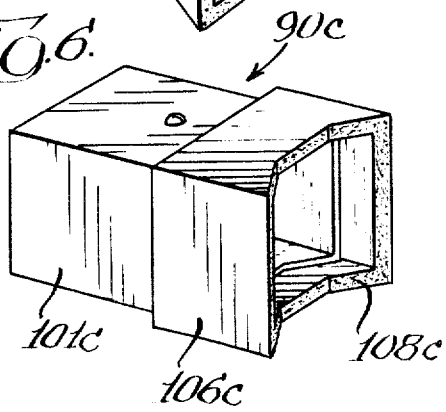
FIG. 6 is a perspective view of yet another type of shroud which may be used with the adapter.

In FIGS. 4–6, alternate constructions for the shroud are shown and permit convenient optional selection of differently configures shroud members which are generally designated 90*a*, 90*b* and 90*c*. In FIG. 4, an adapter 91 releasably mounts the shroud member 90*a*. The adapter 91 has a square cross section and has an open forward end 93 and a rearward wall 94 with gun receiving aperture 95. As before, a rectangular seal member 96 is secured to the backside of the rearward wall 94 and has an aperture 97 which fits snugly about the gun barrel to provide a seal therefor within the adapter aperture 95. An outlet tube 98 is located at the bottom of the adapter 91 and defines an opening 99 through which spent sand and debris are retrieved. The adapter 91 permits the shroud member to be changed without the necessity for removing the gun 13 or disconnecting the sand retrieval line 26; and its square cross section permits each of the configured shroud members to be positioned in any one of four positions of adjustment with respect to the adapter 91.

Each shroud member 90*a*, *b* or *c* has a rigid mounting portion 101*a*, *b* and *c*, respectively, which as a square cross section and is of such size to fit snugly within the open end 93 of the adapter 91. A small detent 103 on the shroud member 90*a*, *b* or *c* engages any one of the indentations or recesses 104 formed in the adapter 91 to releasably lock the selected shroud member inserted therein in any one of four selected positions of adjustment.

In FIG. 4, the working portion 106*a* of the shroud 90*a* has a forward peripheral edge 108*a* which is planar so as to be adapted to work on relatively flat work surfaces. The peripheral edge thereof is defined by a resilient seal member 110.

In FIG. 5, the peripheral edge 108*b* of working portion 106*b* defines a convex 90° corner to permit the shroud to be positioned for work on inside corners or other concave work surfaces. In FIG. 6, the peripheral edge 108*c* of working portion 106*c* is formed with edges angled at 45° and joined by a center chord so that it is concave and is adapted for use on outside corners, pipe and other convex or arcuate work surfaces. The working portions 106*b* and 106*c* are made entirely of resilient material and are fitted tightly onto or glued over the respective square mounting portions 101*b* and 101*c*. The forward edges of the rigid mounting portions 101*a*, *b* or *c* have a shape similar to that of the resilient portions 106*a*, *b* or *c* to provide adequate support therefor. The shroud members can be designed, for example, to precisely direct sand into areas like crevices containing rust along the crimp of a car door or along the surface of an I-beam. The resilient working edges permit the shroud to be pressed against a work surface and substantially conform thereto.

The symmetrical square mounting enables the shroud members to be selectively angularly turned so that the exhaust opening 99 for the adapter 91 can be maintained at the bottom with the tube 98 extending downwardly regardless of the work area against which the shroud member is being applied. For example, the square cross sectional configuration of the adapter permits the shroud member to be placed within the adapter at any one of four positions. This may permit the device to be moved into relatively inaccessible areas.

It is further understood that the performance capacity or capability of the vacuum motor 20 may be varied depending upon the desired rate of air evacuation from the upper cannister which in turn is dependent upon the volume of the shroud and sand retrieval line, the volume of the upper cannister, and degree to which air flows through the barrier established by the abrasive within the cannister. The effectiveness of the abrasive barrier is curtailing or limiting the passage of air between the separated low pressure zones depends upon the particulate nature of the abrasive being used and the depth or extent of the abrasive between these zones. Further, the rate of evacuation of the volume of air from the sand conduit 14 is generally increased as the velocity of pressurized air passing through the gun is increased, and the rate of change of air flow through the adjustable apertures 50 can be made to vary with the effective area of the aperture being used. Thus, in a given design of abrading device utilizing the present invention, the rate at which amounts of abrasive are fed to the gun can be controlled, and at the same time, the velocity with which the abrasive impinges upon a particular working surface can be controlled and varied for maximum operating effectiveness.

While not limited to such use, the device herein is particularly adapted for use in an automobile body-fender shop to repair automobile surfaces, since it is small and portable and can be utilized with conventional air pressure systems found in such shops. Such a device which captures and filters debris would be readily adaptable for use on automobile bodies having surfaces of varying configuration and accessibility.

I claim:

1. A surface treating apparatus comprising a housing containing a supply of abrasive material and having an outlet at the bottom thereof, a gun for directing abrasive material in the direction of a surface area to be abraded and having a passageway defined therethrough, a source of positive pressure air connected to one end of said gun passageway, a conduit having a first end portion connected to said outlet and a second end portion connected to said gun passageway downstream of the connection of said source of positive pressure to said gun, abrasive material from the housing occupying said first end portion under the influence of gravity when the apparatus is inoperative, an aperture formed in said first end portion of the conduit adjacent the abrasive material therein and the housing outlet, the aperture permitting ambient atmospheric pressure to communicate with said conduit downstream to the gun and upstream through said first end portion to the housing only through said outlet, whereby positive pressure air flowing through said gun passageway across the end of said conduit creates a negative pressure in said conduit, the negative pressure in said conduit causing ambient air to flow in through said aperture toward the gun and to draw abrasive material from said first end portion and from said housing through said outlet and to propel said abrasive material to the gun passageway so that positive pressure in said passageway propels the abrasive material onto the surface area.

2. A surface treating apparatus comprising a housing containing a supply of abrasive material having an outlet at the bottom thereof, a source of vacuum connected to the housing and applying a negative pressure to the upper surface layer of said abrasive material, a gun for directing abrasive material in the direction of a surface area to be abraded and having a passageway therethrough, a shroud surrounding the passageway of said gun and bearing against said surface area, a first conduit connecting the inside of said shroud with the inside of said housing above said abrasive material, a source of positive pressure air connected to one end of said gun passageway, a second conduit having a first end portion connected to said outlet and a second end portion connected to said gun passageway downstream of the connection of said source of positive pressure to said gun, abrasive material from the housing occupying said first end portion under the influence of gravity when the apparatus is inoperative, an aperture formed in said first end portion of the second conduit adjacent the abrasive material therein and said housing outlet, the aperture permitting ambient atmospheric pressure to communicate with said second conduit downstream to the gun and upstream through said first end portion to the housing only through said outlet, whereby positive pressure air flowing through said gun passageway across the end of said second conduit creates a negative pressure in said second conduit, the negative pressure in said second conduit causing ambient air to flow in through said aperture toward the gun and to draw abrasive material from said first end portion and from said housing through said outlet and to propel said abrasive material to the gun passageway so that positive pressure in said passageway propels the abrasive material onto the surface area, the negative pressure in said housing above said material causing the return of the abrasive material through the first conduit from the shroud and into the housing above said supply of abrasive material.

3. The surface treating apparatus of claim 2 wherein the first end portion of the second conduit is an outlet tube extending from said housing bottom and said aperture is positioned in said outlet tube.

4. The surface treating apparatus of claim 3 wherein said housing has a concave, hopper-shaped bottom with an outlet formed at the bottom thereof, said bottom funneling abrasive material to said outlet.

5. The surface treating apparatus of claim 4 further including means for varying the size of said aperture.

6. The surface treating apparatus of claim 5 wherein said varying means includes a sleeve surrounding said outlet tube, said sleeve having apertures of varying sizes adapted to be selectively aligned with the aperture in said outlet tube.

7. The surface treating apparatus of claim 6 including pin and slot means for selectively locating said sleeve on said outlet tube.

8. The surface treating apparatus of claim 2 wherein the supply of abrasive material within the housing has a partial depth sufficient to provide a pressure barrier between negative pressure within the housing above the abrasive material and negative pressure in said second conduit.

9. The surface treating apparatus of claim 8 wherein the abrasive material is sand having a minimum depth of about six inches.

10. The surface treating apparatus of claim 2 wherein the shroud end of said first conduit is connected to an adapter having an opening at the rearward end thereof for receiving the gun, said shroud being attached to said adapter and having an open front adapted to be placed in contact with the surface area with abrasive material being propelled against the surface area through said shroud.

11. The surface treating apparatus of claim 10 wherein said adapter includes a resilient seal member at the rear thereof having a bore through which said gun is inserted.

12. The surface treating apparatus of claim 10 wherein said adapter has an open forward end with a square cross section and said shroud has a rearward mounting portion with a similar square cross section which is positioned at the open end of said adapter, the configuration of the adapter and shroud permitting selected angular positioning of the shroud relative to the adapter.

13. The surface treating apparatus of claim 12 wherein said shroud has a working portion made of resilient material defining the front edge thereof and said mounting portion is made of rigid material extending forwardly to a point near the front edge and having a configuration similar to the front edge of the resilient material to provide support therefor.

14. The surface treating apparatus of claim 12 wherein the front edge of said shroud is generally planar for working on flat surface areas.

15. The surface treating apparatus of claim 12 wherein the front edge of said shroud is generally V-shaped and convex for working on a concave surface area.

16. The surface treating apparatus of claim 12 wherein the front edge of said shroud is concave for working on a convex surface area.

17. A surface treating apparatus comprising a housing containing a supply of abrasive material and having an outlet at the bottom thereof, a gun for directing abrasive material in the direction of a surface area to be abraded and having a passageway defined therethrough, a source of positive pressure air connected to one end of said gun passageway, a conduit having a first end portion connected to said outlet and a second end portion connected to said gun passageway downstream of the connection of said source of positive pressure to said gun, abrasive material from the housing occupying said first end portion under the influence of gravity when the apparatus is inoperative, aperture means formed in said first end portion of the conduit adjacent the abrasive material therein and the housing outlet, said aperture means permitting ambient atmospheric pressure to communicate with said conduit downstream to the gun and upstream through said first end portion to the housing only through said outlet, whereby positive pressure air flowing through said gun passageway across the end of said conduit creates a negative pressure in said conduit, the negative pressure in said conduit causing ambient air to flow in through said aperture means toward the gun and to draw abrasive material from said first end portion and from said housing through said outlet and to propel said abrasive material to the gun passageway so that positive pressure in said passageway propels the abrasive material onto the surface area.

18. The surface treating apparatus of claim 17 in which the first end portion of the conduit is an outlet tube extending from said housing outlet in the housing bottom, said aperture means being positioned in the outlet tube.

19. The surface treating apparatus of claim 18 wherein said housing has a concave, hopper-shaped bottom to funnel abrasive material to the housing outlet.

20. The surface treating apparatus of claim 17 further including means for varying the size of said aperture means.

21. The surface treating apparatus of claim 20 wherein said varying means includes a sleeve surrounding said outlet tube, said sleeve having apertures of varying sizes adapted to be selectively aligned with the aperture means in said outlet tube.

22. The surface treating apparatus of claim 21 including pin and slot means for selectively locating said sleeve on said outlet tube.

23. The surface treating apparatus of claim 17 wherein the supply of abrasive material within the housing has a depth sufficient to provide a partial pressure barrier between negative pressure within the housing above the abrasive material and negative pressure in the conduit when the gun is in operation.

24. The surface treating apparatus of claim 23 wherein the abrasive material in the housing has a minimum depth of about six inches.

25. The surface treating apparatus of claim 17 in which the area of the aperture means is in the range of approximately 0.007 square inches to approximately 0.110 square inches.

26. The surface treating apparatus of claim 17 in which the area of the aperture means is in the range of approximately 0.012 square inches to approximately 0.093 square inches.

27. The surface treating apparatus of claim 17 in which the area of the aperture means is in the range of approximately 0.012 square inches to approximately 0.077 square inches.

28. The surface treating apparatus of claim 17 in which pressure regulating means is provided in the source of positive pressure air connected to the gun to vary the pressure in the conduit and the rate of flow of abrasive material through the conduit to the gun.

29. The surface treating apparatus of claim 28 further including means for varying the size of the aperture means so as to vary the rate of flow of abrasive material through the conduit to the gun.

30. A surface treating apparatus comprising a housing containing a supply of abrasive material having an outlet at the bottom thereof, a source of vacuum connected to the housing and applying a negative pressure to the upper surface layer of said abrasive material, a gun for directing abrasive material in the direction of a surface area to be abraded and having a passageway therethrough, a shroud surrounding the passageway of said gun and bearing against said surface area, a first conduit connecting the inside of said shroud with the inside of said housing above said abrasive material, a source of positive pressure air connected to one end of said gun passageway, a second conduit having a first end portion connected to said outlet and a second end portion connected to said gun passageway downstream of the connection of said source of positive pressure to said gun, abrasive material from the housing occupying said first end portion under the influence of gravity when the apparatus is inoperative, aperture means formed in said first end portion of the second conduit adjacent the abraisive material therein and said housing outlet, the aperture means permitting ambient atmospheric pressure to communicate with said second conduit downstream to the gun and upstream through said first end portion to the housing only through said outlet, whereby positive pressure air flowing through said gun passageway across the end of said second conduit creates a negative pressure in said second conduit, the negative pressure in said second conduit causing ambient air to flow in through said aperture means toward the gun and to draw abrasive material from said first end portion and from said housing through said outlet and to propel said abrasive material to the gun passageway so that positive pressure in said passageway propels the abrasive material onto the surface area, the negative pressure in said housing above said material causing the return of the abrasive material through the first conduit from the shroud and into the housing above said supply of abrasive material.

31. The surface treating apparatus of claim 30 in which the first end portion of the second conduit is an outlet tube extending from said housing outlet in the housing bottom, said aperture means being positined in the outlet tube.

32. The surface treating apparatus of claim 31 wherein said housing has a concave, hopper-shaped bottom to funnel abrasive material to said outlet.

33. The surface treating apparatus of claim 30 including means for varying the size of said aperture means to vary the rate of flow of abrasive material through the second conduit to the gun.

34. The surface treating apparatus of claim 33 wherein the first end portion of the second conduit is an outlet tube extending from the housing outlet in the housing bottom and the aperture means is positioned in said outlet tube, said varying means including a sleeve surrounding said outlet tube and having apertures of varying sizes adapted to be selectively aligned with the aperture means in said outlet tube.

35. The surface treating apparatus of claim 34 including pin and slot means for selectively locating said sleeve on said outlet tube.

36. The surface treating apparatus of claim 30 wherein the supply of abrasive material within the housing has a depth sufficient to provide a partial pressure barrier between negative pressure within the housing above the abrasive material and negative pressure in said second conduit.

37. The surface treating apparatus of claim 36 wherein the abrasive material has a minimum depth of about six inches.

38. The surface treating apparatus of claim 30 in which pressure regulating means is provided in the source of positive pressure air connected to the gun to vary the pressure in the second conduit and and the rate of flow of abrasive material through said second conduit to the gun.

39. The surface treating apparatus of claim 38 further including means for varying the size of the aperture means so as to vary the rate of flow of abrasive material through the second conduit to the gun.

40. The surface treating apparatus of claim 30 in which the area of the aperture means is in the range of approximately 0.007 square inches to approximately 0.110 square inches.

41. The surface treating apparatus of claim 30 in which the area of the aperture means is in the range of approximately 0.012 square inches to approximately 0.093 square inches.

42. The surface treating apparatus of claim 30 in which the area of the aperture means is in the range of approximately 0.012 square inches to approximately 0.077 square inches.

43. The surface treating apparatus of claim 30 in which the housing is provided with a separating means positioned above the abrasive material within said housing to screen out large particles returned by the first conduit to the housing and prevent such particles from entering the sound conduit.

44. The surface treating apparatus of claim 30 in which a filter is provided in the housing above the abrasive material, said filter being positioned so that air exhausted from the housing toward the source of vacuum passes through the filter to remove airborne debris from the exhausted air.

45. The surface treating apparatus of claim 44 in which the filter is removable when said filter becomes heavily laden with airborne debris.

46. The surface treating apparatus of claim 30 in which a deflector means is positioned within the housing in the path of abrasive material and debris being returned to the housing by the first conduit.

47. The surface treating apparatus of claim 30 in which the shroud is provided with a resilient seal member surrounding the passageway of the gun so that the gun can be pivotally moved in directing abrasive material against the surface area to be abraded.

* * * * *